US007882883B2

(12) United States Patent
Anderson

(10) Patent No.: US 7,882,883 B2
(45) Date of Patent: Feb. 8, 2011

(54) METHOD FOR MAKING A BARREL FRONT FOR A PAINTBALL MARKER

(76) Inventor: Kenneth K. Anderson, 1915 Yacht Maria, Newport Beach, CA (US) 92660

( * ) Notice: Subject to any disclaimer, the term of this patent is extended or adjusted under 35 U.S.C. 154(b) by 659 days.

(21) Appl. No.: 11/890,146

(22) Filed: Aug. 6, 2007

(65) Prior Publication Data

US 2009/0038601 A1 Feb. 12, 2009

(51) Int. Cl.
*B22D 23/00* (2006.01)
*F41B 11/00* (2006.01)

(52) U.S. Cl. ..... 164/46; 124/83; 427/250; 427/375; 427/404

(58) Field of Classification Search ..... 124/83; 164/46, 271; 427/248.1, 250, 251, 253, 255.26, 427/255.28, 331, 372.2, 375, 383.1, 402, 427/404

See application file for complete search history.

(56) References Cited

U.S. PATENT DOCUMENTS 3,397,732 A * 8/1968 Howell, Jr. ..... 164/46
RE31,354 E * 8/1983 Eckner ..... 138/131
4,577,431 A * 3/1986 Siemers et al. ..... 42/76.02
4,606,953 A * 8/1986 Suzuki et al. ..... 138/143
4,839,204 A * 6/1989 Yoshino et al. ..... 428/35.8
6,689,440 B2 * 2/2004 Hsich et al. ..... 428/36.91

* cited by examiner

*Primary Examiner*—John Ricci
(74) *Attorney, Agent, or Firm*—Morland C. Fischer

(57) ABSTRACT

Disclosed is a method for making a non-metallic, fiber-reinforced barrel tube having particular application for use in a barrel system to be attached to a paintball marker in order to direct paintballs propelled by the marker towards a target. A mandrel is first dipped in a releasing agent. The mandrel is then coated with a thin layer of metal (e.g., nickel or chrome) by means of a nano vapor deposition process. Next, a fiber-reinforced resinous sheet is wrapped over the thin metal layer to establish a tube therearound. A heat-sensitive plastic tape is wound around the tubular resinous sheet. The mandrel is heated in an oven to cause the thin metal layer to bond to the tubular resinous sheet. At the same time, the heat-sensitive tape shrinks to squeeze any air bubbles from the resinous sheet. After heating and curing, the mandrel is pulled outwardly from the tubular fiber-reinforced resinous sheet to produce a hollow, cylindrical barrel tube ready for cutting to size and machining so as to be coupled to the paintball marker.

10 Claims, 6 Drawing Sheets

METHOD FOR MAKING A BARREL FRONT FOR A PAINTBALL MARKER

BACKGROUND OF THE INVENTION

1. Field of the Invention

This invention relates to a method for making a non-metallic, fiber-reinforced front for a barrel system of the kind to be coupled to a paintball marker to direct paintballs propelled therethrough towards an intended target.

2. Background Art

The game of paintball is rapidly growing in popularity around the world. Participants use pressurized gas paintball markers to propel paintballs down a barrel system to be directed towards a target or each other. Many conventional barrel systems are manufactured from metal (e.g., extruded bar stock or drilled from aluminum). As a consequence of the metallic barrel system, a paintball is subjected to high-friction forces, particularly as it travels down a one-piece barrel system. Hence, the velocity at which the paintball exits the front of the barrel system is typically reduced. Moreover, the metallic barrel system may contain grooves or other imperfections that are introduced during machining which can sometimes impart a spin to the paintball that may alter its direction or adversely affect the aim of the player. Metallic barrel systems are known to include a stepwise taper to reduce pressure and improve accuracy. However, such a stepwise taper is very abrupt for a rapidly-moving paintball. Thus, the paintball may experience turbulence as it exits the front of the barrel system leaving the player with less accuracy and control.

Some barrel systems have been manufactured with a non-metallic woven mesh liner surrounding a hollow bore through which the paintball is propelled. The texture of the mesh liner may cause the fragile gelatin capsule around the paintball to rupture and thereby allow paint to be spilled along the bore. The texture of the mesh liner also makes it difficult to clean the barrel system and remove the paint from the bore thereof.

Therefore, it would be desirable to have a reliable method consisting of a relatively few number of steps for manufacturing a high-strength, non-metallic barrel front for a paintball marker, wherein the barrel front has a longitudinally-extending bore with a smooth, hard surface that will not easily scratch or negatively impact the speed or direction of a paintball being propelled therethrough.

SUMMARY OF THE INVENTION

In general terms, a method is disclosed, consisting of a relatively few number of steps, for manufacturing the front of a barrel system to be coupled to a paintball marker of the kind used during the game of paintball. By virtue of the present method, the barrel system front is manufactured as a high-strength, non-metallic cylindrical tube having a longitudinally-extending bore with a smooth, hard inside bore surface that avoids imperfections and reduces forces that might adversely affect the speed or direction of a paintball being propelled therethrough.

Initially, a mandrel is covered with a releasing agent, such as a silicone oil or grease. The mandrel is then dipped in a bath or basin so as to be coated with a very thin (e.g., 0.002 inches) layer of hard metal (e.g., nickel, chrome, or the like). The metal coating is preferably applied by means of a nano vapor deposition (NVD) process to produce a smooth, hard finish along the bore through the finished barrel tube. Next, the mandrel is wrapped by a fiber-reinforced resinous sheet to create a tube around the mandrel. In accordance with a preferred embodiment, the resinous sheet contains non-metallic (e.g., carbon or glass) fibers that are embedded in an epoxy resin. A heat-sensitive (e.g., polypropylene) tape is then wound around the tubular resinous sheet.

The mandrel is heated in an oven until the thin metal coating bonds to the tubular, fiber-reinforced resinous sheet and the heat-sensitive tape winding therearound shrinks to squeeze air bubbles and excess resin from the sheet. The mandrel is then removed from the oven to permit the resinous sheet to cure. At this point, the mandrel is withdrawn from the tubular resinous sheet to establish a hollow longitudinally-extending bore with the thin metal coating bonded to the surface thereof. The tape is now ground off the tubular sheet to produce a smooth outside finish. Finally, the tubular resinous sheet having a bore extending longitudinally therethrough is cut to size to create a finished cylindrical barrel tube that can be machined so as to be adapted to be coupled to other parts of the barrel system or directly to the paintball marker.

DESCRIPTION OF THE PREFERRED EMBODIMENT

Figure 1:
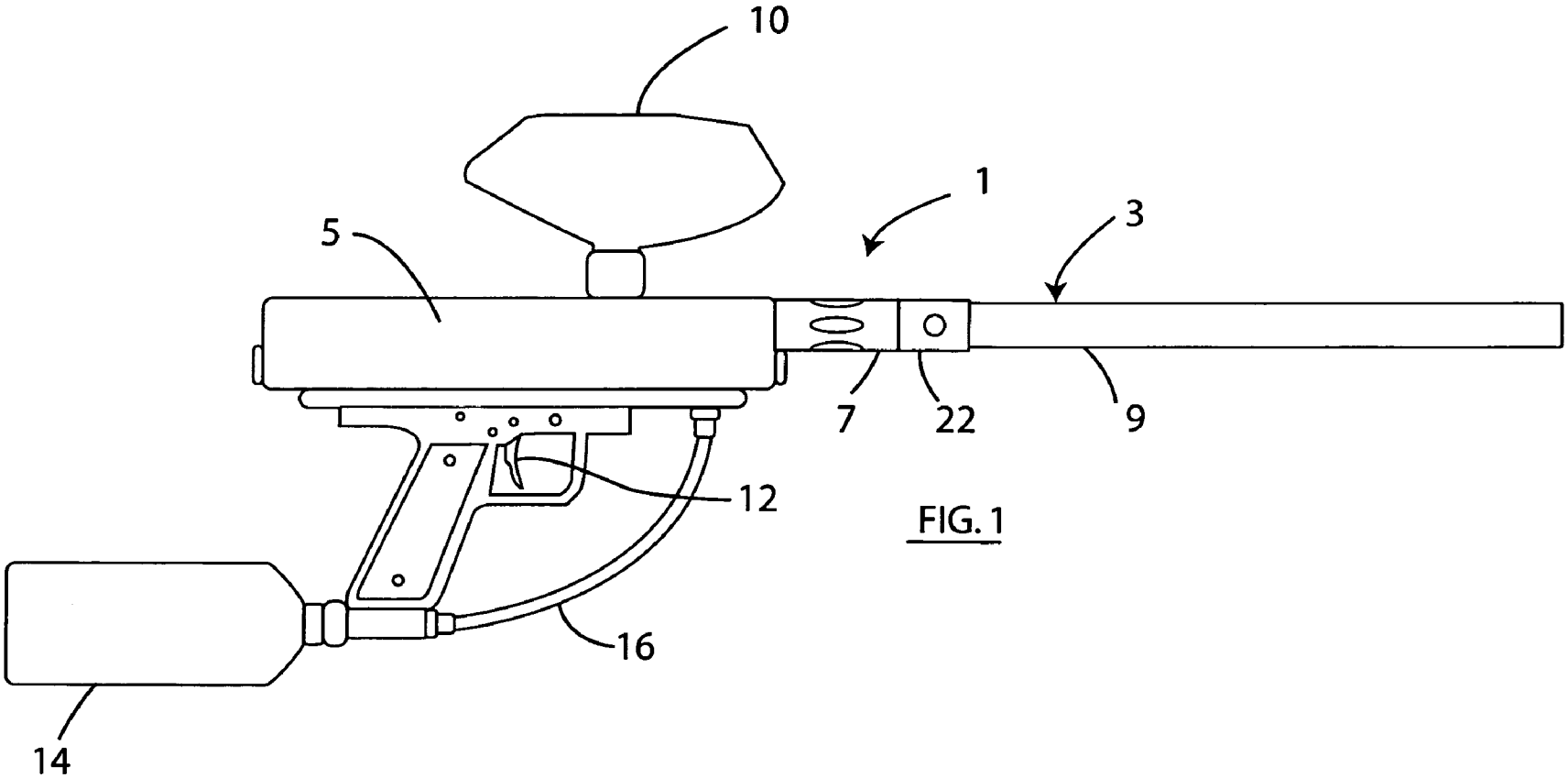
FIG. 1 shows a paintball marker with one example of a barrel system to which the presently-disclosed method of making is applicable.

FIG. 1 of the drawings shows a paintball marker 1 having a barrel system 3 to be manufactured according to a method which forms the present invention. The barrel system 3 is adapted to be removably connected to a body 5 of the paintball marker 1 to direct paintballs that are propelled therethrough towards an intended target. By way of particular example, the barrel system 3 of the paintball marker 1 of FIG. 1 includes a hollow breech 7 located at the rear end thereof and a hollow front or tip 9 located at the opposite end and coupled to the breech 7.

As in the case of many paintball markers, the paintball marker 1 of FIG. 1 includes a hopper 10 into which a supply of paintballs (not shown) is loaded so as to be dispensed, under pressure, through the bore of the barrel system 3. Paintballs from the hopper 10 are delivered into the body 5 to be propelled through the barrel system 3 when a trigger 12 is activated by a user. To this end, a propellant tank 14 that is filled with a source of gas under pressure (e.g., typically compressed air or carbon dioxide) communicates with the body 5 by means of tubing 16. The pressurized gas within propellant tank 14 provides the driving force to propel paintballs through the breech 7 and front 9 of barrel system 3 when the user depresses the trigger 12.

Also like many paintball markers, the breech 7 of the barrel system 3 has a screw fitting 20 at the distal end thereof by which the breech can be removably connected to the body 7 of paintball marker 1. The breech 7 provides a controlled glide area that is sized to snuggly engage the paintballs being propelled through the barrel system 3 in order for the paintballs to build up speed. Therefore, the breech 7 is often interchangeable with other breeches having a variety of bore dimensions to correspond with different sizes of the paintballs to be loaded into the hopper 10.

A coupler 22 is located at the distal end of the front 9 of barrel system 3. The coupler 22 is provided with a screw fitting 24 that is adapted to be mated to a corresponding threaded receptacle (not shown) formed at the proximal end of the breech 7 whereby the front 9 is detachably connected to the breech 7 to complete the barrel system 3 of the paintball marker 1. Like the breech 7 of barrel system 3, it may be desirable that the front 9 also be interchangeable with other fronts having a variety of bore dimensions depending upon the desired overall length of a barrel system and/or the size of the paintballs to be propelled through the barrel system. In some cases, the paintball marker may include a one-piece barrel system rather than the system 3 of FIG. 1 having a separate breech 7 and front 9.

Figure 2:
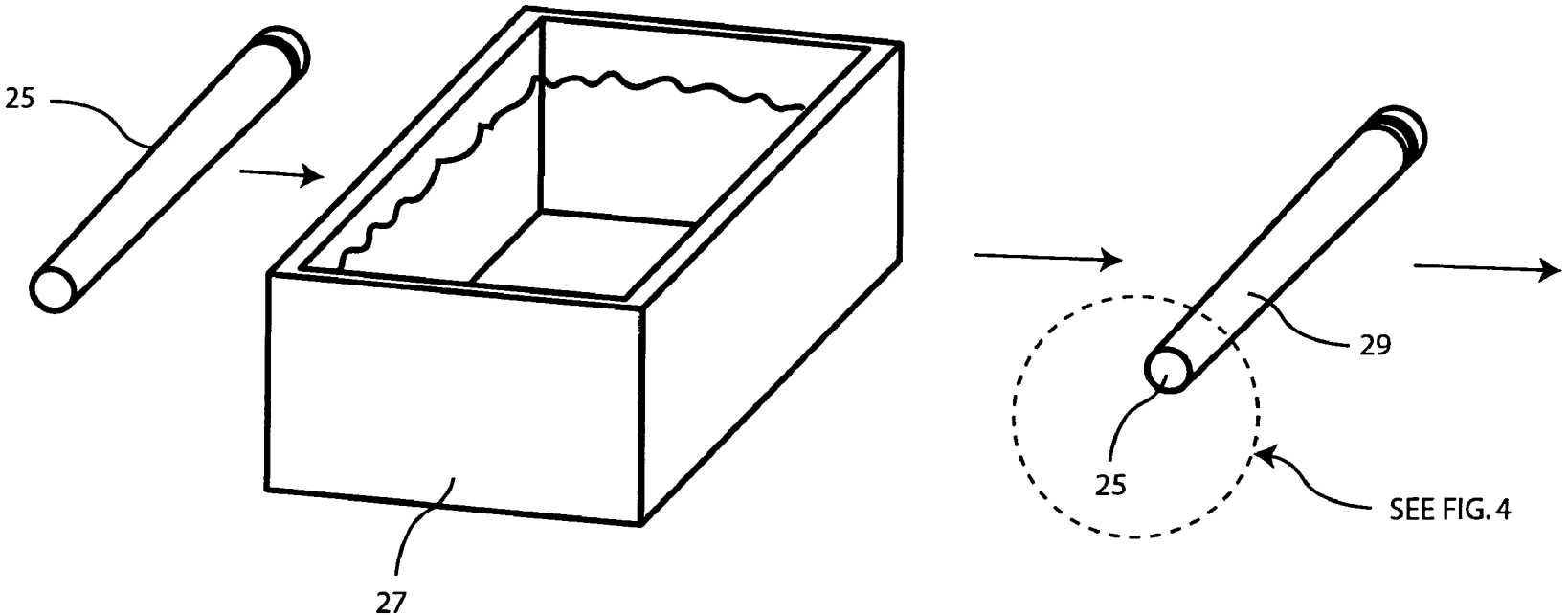
FIGS. 2 and 3 illustrate steps from the method for making the front of a barrel system for a paintball marker which forms the present invention.

Referring to FIG. 2 of the drawings, the steps are now described for making a non-metallic, fiber-reinforced front 9 for the barrel system 3 of the paintball marker 1 of FIG. 1. The front 9 is manufactured by using a solid metal (e.g., steel) mandrel 25 having a length of approximately 3 feet. The metal mandrel 25 is first dipped in a releasing agent (such as, for example, silicone-based oil or grease) for an important purpose that will soon be explained.

The mandrel 25 is then placed into a bath or basin 27 so as to be coated with a hard metal (preferably nickel, chrome, or the like) by means of a well-known nano vapor deposition (NVD) process. The nano layer 29 of nickel or chrome has an ideal thickness lying in a range of thicknesses between 0.0254 mm and 0.127 mm. An NVD process involving nano-sized particles is desired to enhance the ability of the nickel or chrome layer 29 to adhere to mandrel 25. In addition, the hard metal layer 29 will be very thin, smooth and less likely to scratch or flake during prolonged use of the finished barrel front 9.

Figure 3:
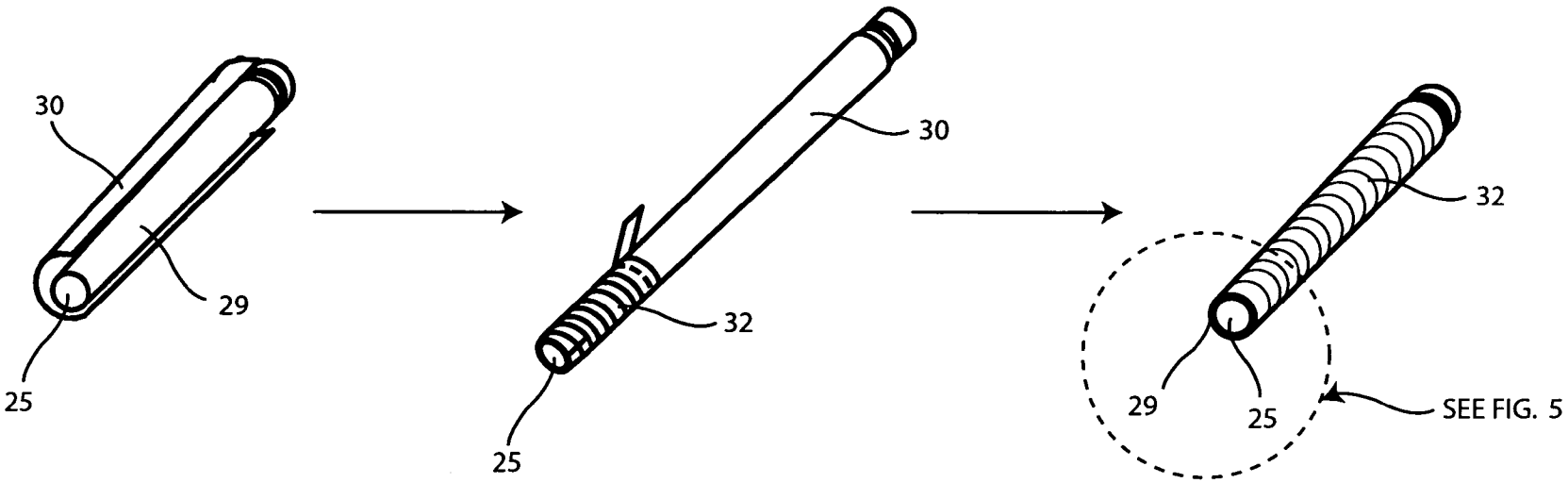

Continuing at FIG. 3 of the drawings, the nano-coated mandrel 25 is wrapped by a non-metallic fiber-reinforced sheet 30. Sheet 30 preferably includes carbon fibers that are embedded in an (e.g., epoxy) resin. However, the fiber-reinforced sheet 30 can contain fibers manufactured from suitable non-metallic materials (e.g., glass) other than carbon. In the present example, the carbon fiber-reinforced sheet 30 is wrapped around the mandrel by means of a conventional table rolling technique. In this case, the rolled sheet 30 creates a cylindrical tube surrounding mandrel 25.

Next, the wrapped mandrel 25 is wrapped a second time by winding a suitable thermoplastic (e.g., polypropylene) heat-sensitive tape 32 therearound. The twice-wrapped mandrel 25 is placed into an oven where it is initially heated for one hour at a temperature of approximately 80 degrees C. The temperature is then raised to approximately 130 degrees C for another hour. The precise heating time and temperature of the twice-wrapped mandrel 25 will depend upon the characteristics of the resin (e.g., epoxy) used to make the aforementioned fiber-reinforced sheet 30 which forms the first of the two wraps around the mandrel.

The twice-wrapped mandrel 25 is removed from the oven at the end of the (e.g., two hour) heating period and permitted to cure for about 1 to 2 additional hours. During the prior heating step, the heat-sensitive tape 32 will melt and shrink so as to be squeeze any air bubbles from the resin of the tubular fiber-reinforced sheet 30 wrapped around mandrel 25. Excess resin will also be squeezed from sheet 30.

Figure 5:
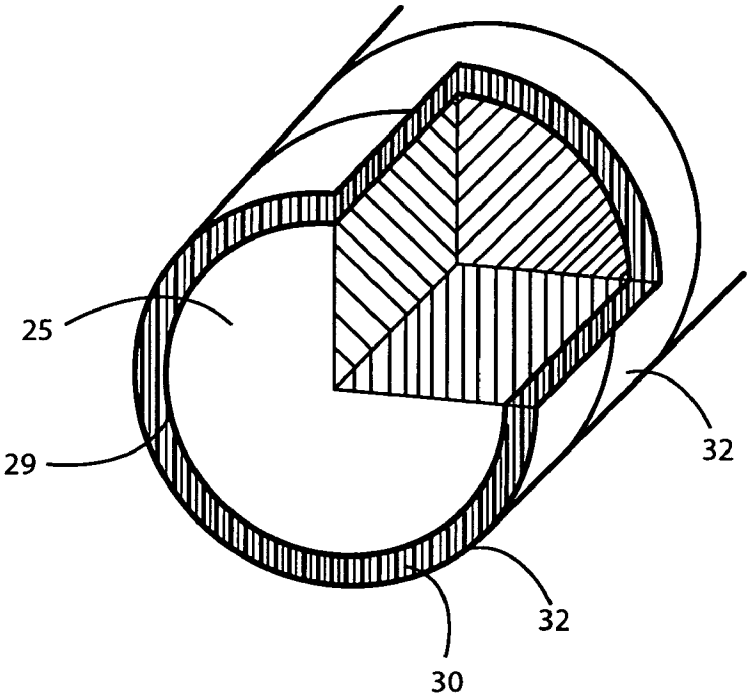
FIGS. 4 and 5 represent enlarged details from the method steps of FIGS. 2 and 3.
Figure 4:
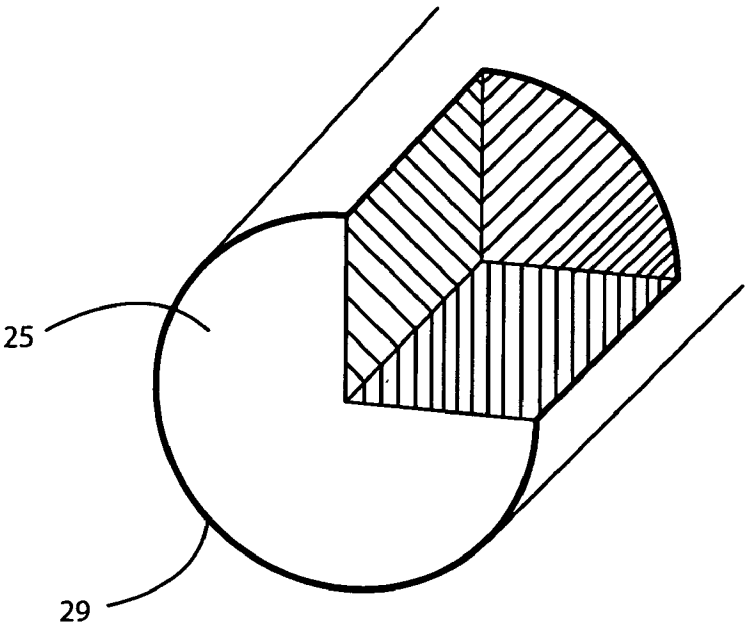

Turning briefly to FIGS. 4 and 5 of the drawings, details are illustrated of the hereinabove described method for making the front 9 of the barrel system 3 of the paintball marker 1. More particularly, FIG. 4 illustrates the solid mandrel 25 coated with the metallic nano layer 29 of nickel or chrome by means of a nano vapor deposition process once mandrel 25 is placed into the basin 27 of FIG. 2. FIG. 5 illustrates the nano-coated mandrel 25 of FIG. 4 wrapped by the non-metallic fiber-reinforced sheet 30 to create a cylindrical tube therearound.

Figure 6:
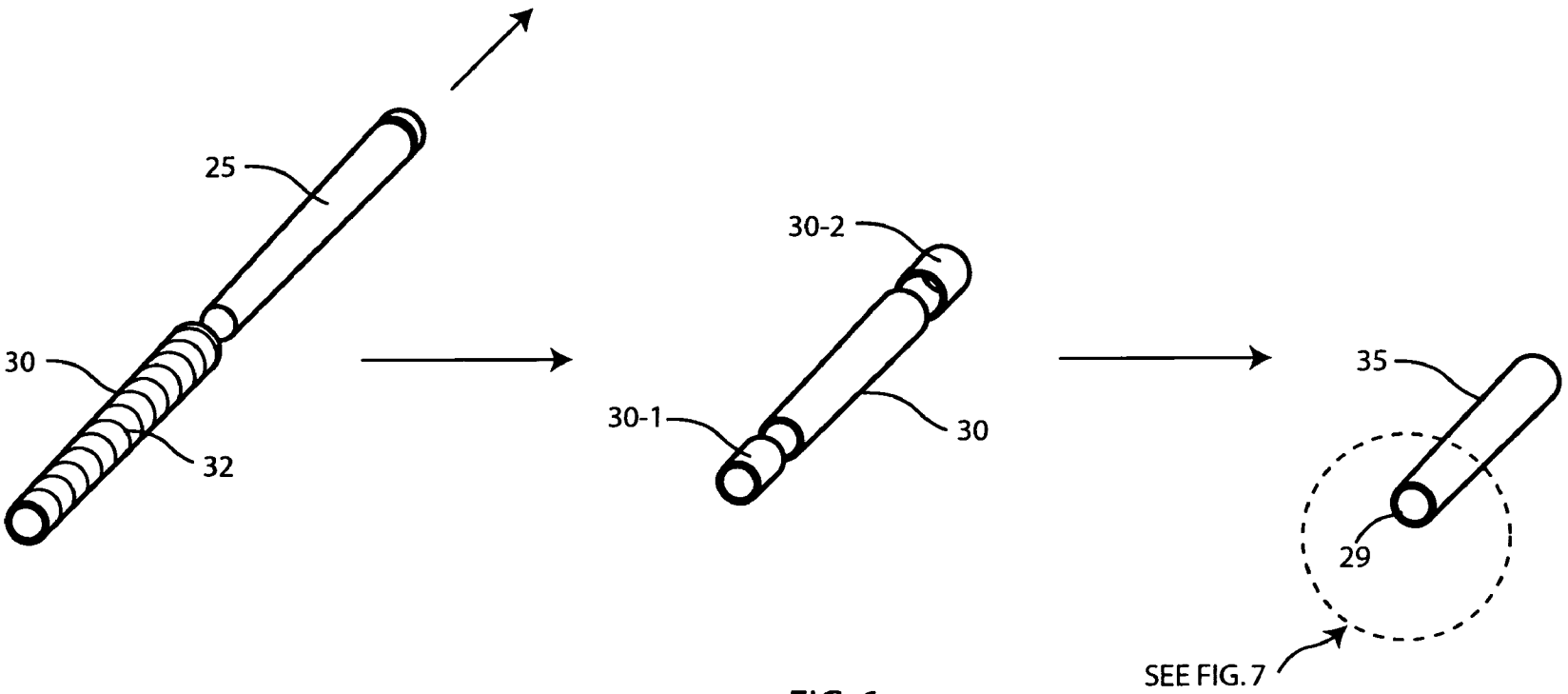
FIG. 6 illustrates additional steps from the method for making the front of a barrel system.

Returning to the method of the present invention, FIG. 6 of the drawings shows the mandrel 25 being pulled or otherwise drawn outwardly from the interior of the cylindrical tube created by wrapping the non-metallic fiber-reinforced sheet 30 around the mandrel. The withdrawal of mandrel 25 from the tubular sheet 30 is facilitated by the initial step of dipping the mandrel into a suitable releasing agent, as earlier described. In this same regard, and as an important feature of this invention, the hard metal nano layer 29 (of FIG. 4) which coats the mandrel 25 will remain with and bond to the interior of the tubular sheet during the aforementioned heating step. That is to say, the presence of a release agent covering the mandrel 25 and the adhesive nature of the heated resin from tubular sheet 30 advantageously prevent nano layer 29 from fusing to the mandrel 25 and being withdrawn therewith as mandrel 25 slides outwardly and away from the tubular sheet 30.

The outside surface of tubular sheet 30 is now ground down in order to remove any excess resin as well as the plastic tape 32 wound thereover so as to create a smooth finish. Next, one or both ends 30-1 and 30-2 of the tubular sheet 30 are cut off and discarded to achieve a finished non-metallic, fiber-reinforced cylindrical barrel tube 35 with a desired length, typically lying in a range of lengths between 12 to 18 inches, having particular application for use as the front 9 of the barrel system 3 of the paintball marker 1 of FIG. 1. To this end, the barrel tube 35 can be machined to include (e.g., screw-threaded) connectors to be mated to other parts of the barrel system 3 and/or directly to the marker 1.

Accordingly, the cylindrical barrel tube 35 will have a thin, durable metallic (e.g., nickel or chrome) coating 29 at the inside thereof and a relatively thick, non-metallic elongated tubular body at the outside with a hollow bore running longitudinally therethrough. The hard metallic coating 29 is capable of withstanding scratching as a paintball is propelled downwardly through the bore of barrel tube 35. What is more, the smooth (i.e., polished) coating 29 along the bore reduces surface imperfections so as to correspondingly reduce the forces which might alter the speed or direction of the paintball being aimed towards an intended target.

Figure 7:
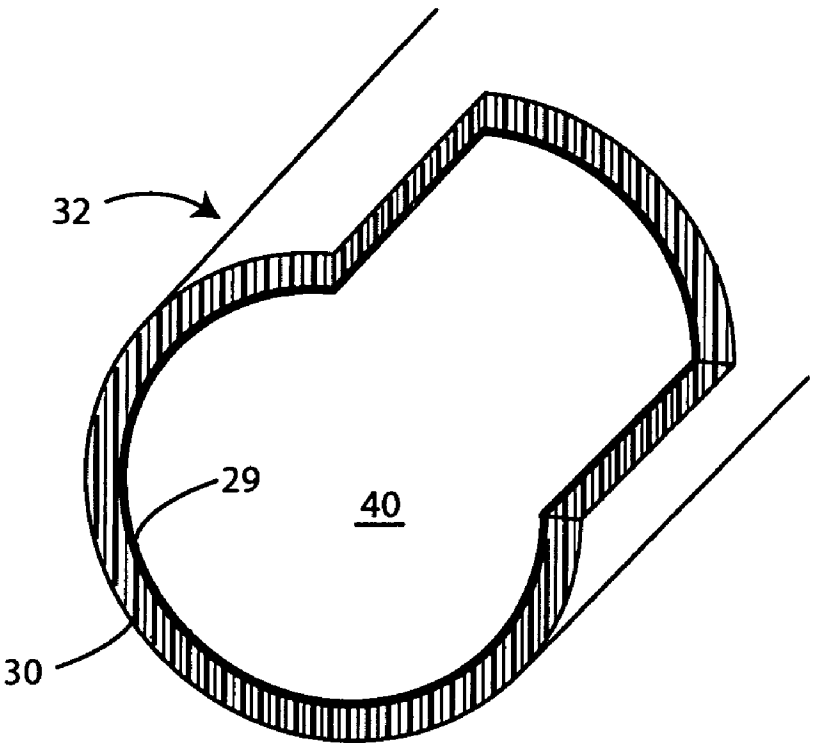
FIG. 7 represents an enlarged detail from the method steps of FIG. 6.

FIG. 7 of the drawings illustrates details of the finished barrel tube 35 of FIG. 6 at the conclusion of the method steps described above. In particular, the cylindrical barrel tube 35 is shown (prior to machining) having the thin, durable metallic coating 29 running along the inside, a relatively lightweight non-metallic, fiber-reinforced tubular sheet 30 at the outside, and a hollow bore 40 running longitudinally through the tubular sheet. The diameter of the bore 40 of barrel tube 35 will vary from one barrel system 3 to the next in order to accommodate paintballs having different sizes to meet the needs of the user and the conditions in which the game of paintball is played.

The invention claimed is:

1. A method for making a hollow barrel tube for use with a paintball marker to direct paintballs propelled by the paintball marker towards a target, said method comprising the steps of:

covering a mandrel with a releasing agent;

coating the mandrel with a layer of metal;

surrounding the metal layer of the mandrel with a resinous sheet to establish a tube therearound;

heating the mandrel, the metal layer, and the tubular resinous sheet for causing said metal layer to bond to said resinous sheet; and withdrawing the mandrel from the tubular resinous sheet for producing said hollow barrel tube having a longitudinally extending bore with said layer of metal running along the bore through said barrel tube.

2. The method recited in claim 1, wherein said releasing agent to cover the mandrel is one of a silicone-based oil or grease.

3. The method recited in claim 1, wherein said layer of metal to coat the mandrel is one of nickel or chrome.

4. The method recited in claim 1, comprising the additional step of coating the mandrel with said layer of metal by means of nano vapor deposition.

5. The method recited in claim 1, wherein the step of heating the mandrel, the metal layer, and the tubular resinous sheet includes applying heat thereto at a first temperature for a first heating time and then applying heat thereto at a raised temperature for an additional heating time so as to cause said metal layer to bond to said resinous sheet.

6. The method recited in claim 1, wherein said resinous sheet includes non-metallic fibers embedded within a resin.

7. The method recited in claim 6, wherein said resin is epoxy resin and said non-metallic fibers are manufactured from one of carbon or glass.

8. The method recited in claim 1, comprising the additional steps of winding a heat-sensitive tape over said tubular resinous sheet surrounding said metal layer of the mandrel prior to said heating step, and heating said heat-sensitive tape together with said resinous sheet during said heating step for causing said tape to shrink around and apply pressure to said resinous sheet.

9. The method recited in claim 8, comprising the additional step of grinding said heat-sensitive tape off said tubular resinous sheet after the step of heating said heat-sensitive tape together with said resinous sheet.

10. The method recited in claim 1, comprising the additional steps of cutting off one or both of the opposite ends and machining said tubular resinous sheet following said mandrel withdrawing step so that the hollow barrel tube is adapted and sized to be coupled to the paintball marker.

* * * * *